US005170578A

United States Patent [19]

Pampel

[11] Patent Number: 5,170,578

[45] Date of Patent: Dec. 15, 1992

[54] INDICIA-BEARING ATTACHMENT FOR ELECTRICAL CONDUCTORS

[75] Inventor: Juergen Pampel, Bad Salzuflen, Fed. Rep. of Germany

[73] Assignee: C.A. Weidmueller GmbH & Co., Detmold, Fed. Rep. of Germany

[21] Appl. No.: 873,979

[22] Filed: Apr. 27, 1992

Related U.S. Application Data

[63] Continuation of Ser. No. 625,136, Dec. 7, 1990, abandoned.

[30] Foreign Application Priority Data

Dec. 15, 1989 [DE] Fed. Rep. of Germany ..... 3941475

[51] Int. Cl.[5] ..... G09F 3/00

[52] U.S. Cl. ..... 40/316; 40/658; 24/134 R

[58] Field of Search ..... 40/316, 317, 306, 309, 40/658; 24/134 R, 132, 170; 174/140 S, 154, 167, 168

[56] References Cited

U.S. PATENT DOCUMENTS

| | | | |
|---|---|---|---|
| 2,649,635 | 8/1953 | Peterson | 24/134 R X |
| 3,773,290 | 11/1973 | Mowery | 24/134 R X |
| 3,861,641 | 1/1975 | Kolic | 24/134 R X |
| 4,899,474 | 2/1990 | Piana et al. | 40/316 |

FOREIGN PATENT DOCUMENTS

| | | | |
|---|---|---|---|
| 674239 | 11/1963 | Canada | 40/316 |
| 404988 | 6/1989 | European Pat. Off. . | |
| 1216228 | 12/1970 | United Kingdom | 40/316 |

*Primary Examiner*—Kenneth J. Dorner
*Assistant Examiner*—Milton Nelson, Jr.
*Attorney, Agent, or Firm*—Laubscher & Laubscher

[57] ABSTRACT

An indicia-bearing attachment for electrical conductors includes a hollow generally U-shaped housing having a horizontal top wall and a pair of downwardly-depending side walls, thereby to define an open-ended chamber for longitudinally receiving at either end one end of the conductor depending on the orientation of the housing for proper reading of the indicia. In order to maintain the conductor in the chamber adjacent the horizontal top wall, a T-shaped clamp member is pivotally connected between the lower ends of the side walls, two arms of the clamp member being horizontal and colinearly arranged longitudinally in the chamber, and a third arm being vertical and joined to the adjacent ends of the horizontal arms. The lengths of the arms are such that when the conductor end is inserted within the chamber, the vertical arm is engaged by the conductor extremity to pivot the clamp member to cause one of the horizontal arms to engage the lower surface of the conductor and thereby support the conductor in the housing.

6 Claims, 4 Drawing Sheets

INDICIA-BEARING ATTACHMENT FOR ELECTRICAL CONDUCTORS

This application is a continuation, abandoned Apr. 27, 1992, of application Ser. No. 07/625,136, filed Dec. 7, 1990.

BACKGROUND OF THE INVENTION

1. Field of the Invention

This invention relates to an indicia-bearing attachment adapted for connection at either end with one end of an electrical conductor.

2. Brief Description of the Prior Art

Indicia-bearing attachments for electrical conductors are well known in the prior art and generally include a hollow housing having a horizontal top wall, a pair of downwardly extending side walls, and a clamping tongue that acts on the lower surface of a conductor that has been longitudinally inserted within the housing. In the indicia-bearing attachment of the European patent No. 89 11 897.8, the clamping device consists of a clamping tongue that is molded with one of its ends upon the bottom area of the carrier body, said tongue extending with its free clamp end obliquely inwardly toward the upper indicia-bearing wall of the information carrier body. In view of the otherwise closed hollow profile of the carrier body, this design leads to the fact that the electrical conductor is well-guided during insertion within the housing, and that considerable clamping force can also be achieved via the clamping tongue, whereby conductors with a large diameter range can be inserted. Because of the design there, the conductor however can always be inserted only from one side into the carrier body of the information display device or the information display device can be pushed over an electrical conductor only from one side. As far as assembly is concerned, this can entail problems. One must also keep in mind that such information display devices are frequently labeled identically in print and therefore are legible only from the right or from the left. The purpose of the present invention therefore is to create an information display device of the type mentioned which can be pushed longitudinally upon the conductor to be marked alternately from either direction, retaining simple assembly and a reliable clamping possibility.

SUMMARY OF THE INVENTION

Accordingly, a primary object of the present invention is to provide an indicia-bearing attachment including a generally U-shaped housing having a top wall and a pair of downwardly directed side walls defining an open-ended chamber, thereby to receive at either end one end of a conductor, clamping means being connected between the lower ends of the side walls for biasing the conductor upwardly in the chamber toward the housing top wall. The clamping means include a generally T-shaped clamp member having a pair of colinear horizontal arms arranged longitudinally in the chamber, and a vertical arm that extends upwardly from a juncture with the adjacent ends of the horizontal arms. The clamp member is connected for pivotal movement relative to the housing about a pivot axis that extends normal to the clamping member at the point of juncture of said arms. The vertical arm is arranged for engagement by the extremity of a conductor inserted longitudinally from either end of the housing, whereby the clamp member is pivoted by the conductor to cause one of the horizontal arms to engage the adjacent bottom surface of the conductor, thereby to support the conductor in the housing. Upon further insertion of the conductor in the housing, the resilient arms of the clamping member are deformed to provide a two-point support for resiliently biasing the conductor upwardly in the housing chamber. Thus, depending on the direction of reading of the indicia, the conductor may be introduced within either end of the attachment body. Owing to the provision of the pivotally mounted T-shaped clamping member, the information display device can be mounted upon an electrical conductor to be marked specifically, by means of simple installation and reliable clamping. The insertion areas in the housing for the electrical conductor remain essentially free. During insertion, the electrical conductor directly runs into the middle clamping arm of the clamp member. Upon further mutual insertion, the clamp member is turned by the engagement by the conductor with the middle arm until, depending upon the plug-in direction, one of the two other clamp arms also comes into engagement with the electrical conductor. Upon further insertion, there is the desired resilient deformation of both clamping arms that then act upon the clamp member, and thus a stable double clamping of the conductor is effected in accordance with its diameter, by engagement with upper, more stable labeling receiver. As far as assembly is concerned, one is completely free as to the direction of insertion assembly and one is free especially in the interest of the particular desired direction of reading regarding the direction in which the information display device is pushed up on the electrical conductor.

According to a more specific object of the invention, the resilient arms of the T-shaped clamp member compensate for conductors of various diameters. Further spaced resilient clip arms may depend downwardly from the horizontal top housing wall, whereby the lower and upper surfaces of the conductor are each supported at two locations, thereby contributing to good clamping action, and during the insertion phase, being reliable guiding of the conductor to the vertical arm of the clamp member.

BRIEF DESCRIPTION OF THE DRAWINGS

Other objects and advantages of the invention will become apparent from a study of the following specification when viewed in the light of the accompanying drawing, in which.

DETAILED DESCRIPTION

Figure 1:
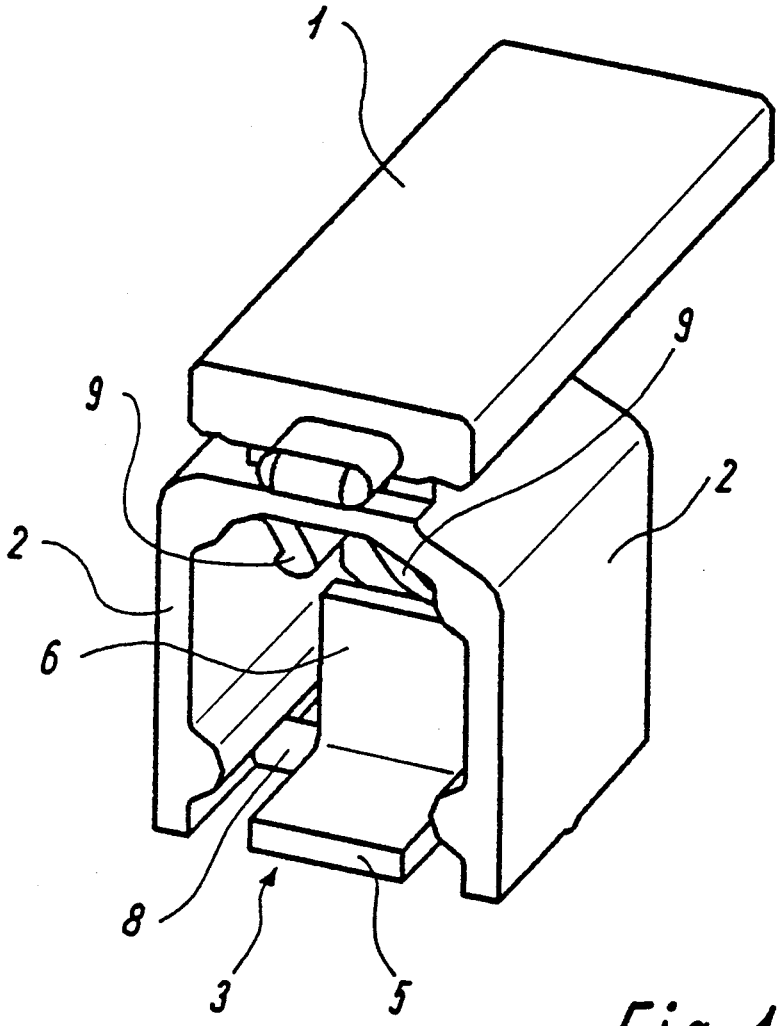
FIG. 1 is an upper right-hand perspective view of the indicia-bearing attachment prior to mounting on a conductor.
Figure 2:
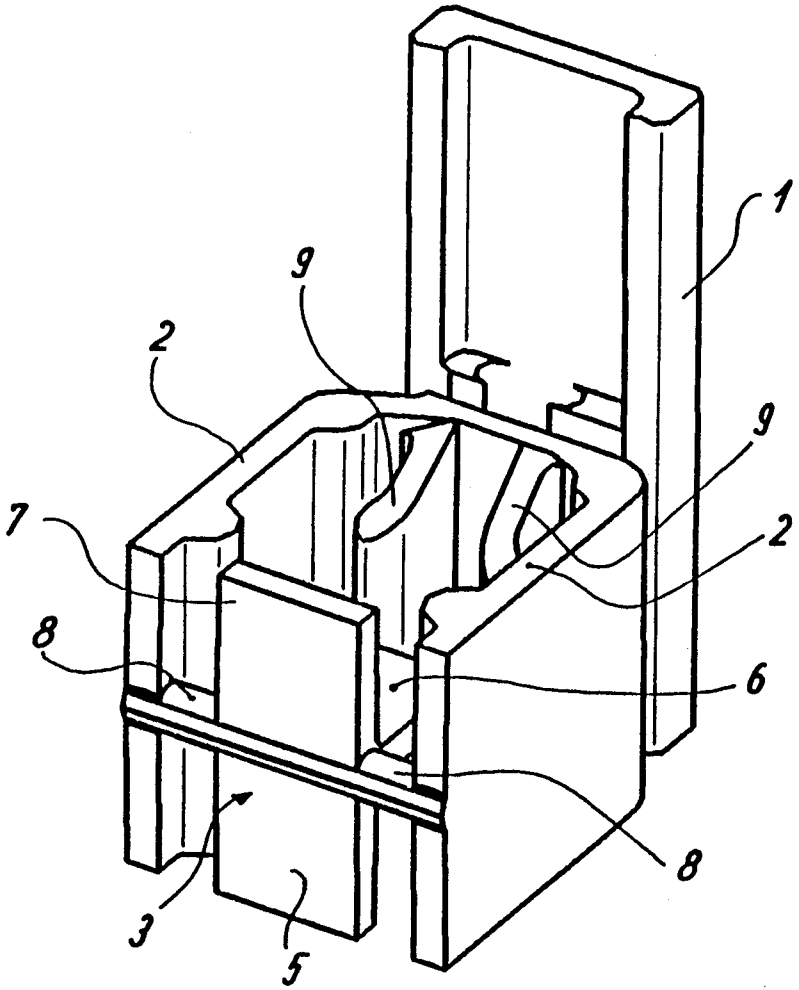
FIG. 2 is a lower left-hand perspective view of the attachment of FIG. 1.
Figure 3:
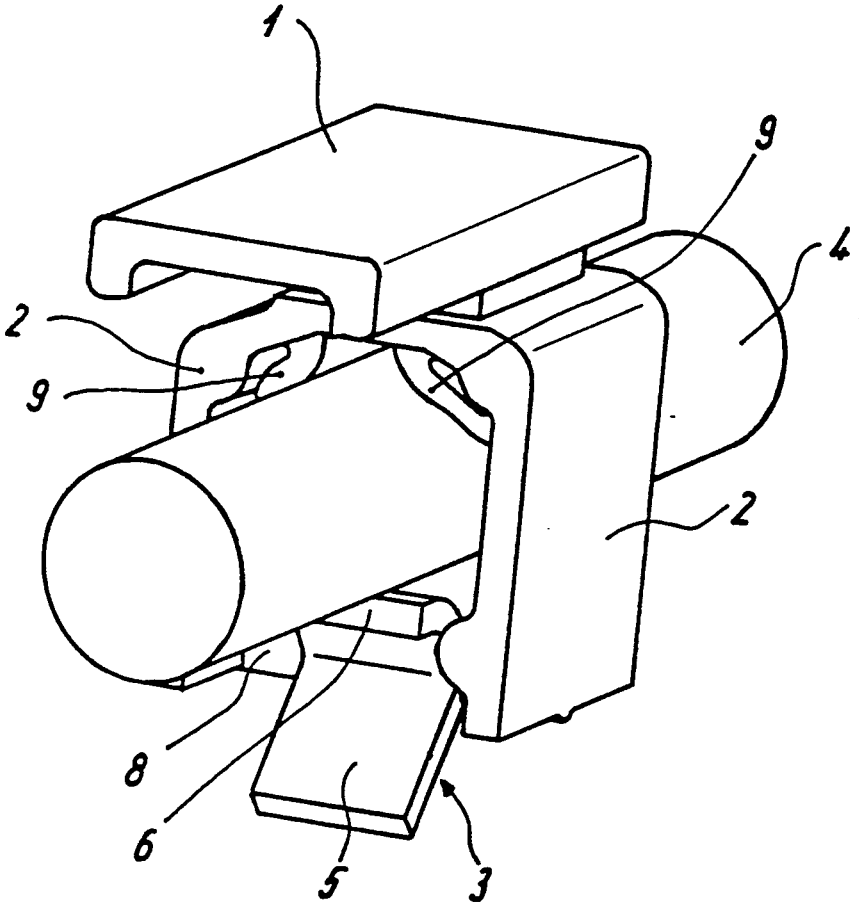
FIG. 3 is an upper right-hand perspective view of the attachment mounted on a conductor.

Referring first more particularly to FIGS. 1 and 2, the indicia bearing attachment for electrical conductors includes a generally U-shaped housing having horizontal indicia-bearing top wall 1, and a pair of spaced downwardly depending side walls 2, for defining therebetween an open-ended chamber for receiving at either end of the housing one end of the conductor 4, as shown in FIG. 3.

In accordance with a characterizing feature of the invention, there is pivotally mounted between the lower ends of the side walls a generally T-shaped inverted clamp member 3 having a pair of co-linearly arranged horizontal arms 5 and 7 extending longitudinally of the housing chamber, and a vertical arm or stem 6 that is orthogonally arranged relative to the horizontal arms 5 and 7. The clamp member 3 is connected for pivotal movement about an axis that extends normal to the point of juncture of the three arms, which pivotal axis extends transversely of the housing between the side walls 2 and, as shown in FIG. 3, is spaced from the top wall by a distance greater than the length of the vertical arm 6. As shown in FIG. 3, the clamp member 3 is rotatably mounted (by a snap-fit connection, for example) onto a fixed pivot rod 8 that is secured at either end to the associated side walls 2. Alternatively, the clamp member 3 could be secured to the pivot rod 8 which in turn is rotatably connected at each end with the associated side walls 2.

Extending downwardly from the top wall 1 between the side walls 2 are a pair of laterally spaced resilient clip legs or fingers 9, which are adapted to engage the upper surface of the conductor 4 as shown in FIG. 3.

Preferably, the conductor 4 is provided with an insulated cover layer 4*a*, and the attachment housing and clamp member 3 are formed of metal. Alternatively, the housing and clamp member 3 might be formed of a suitable synthetic plastic material, such as polyurethane.

Figure 4:
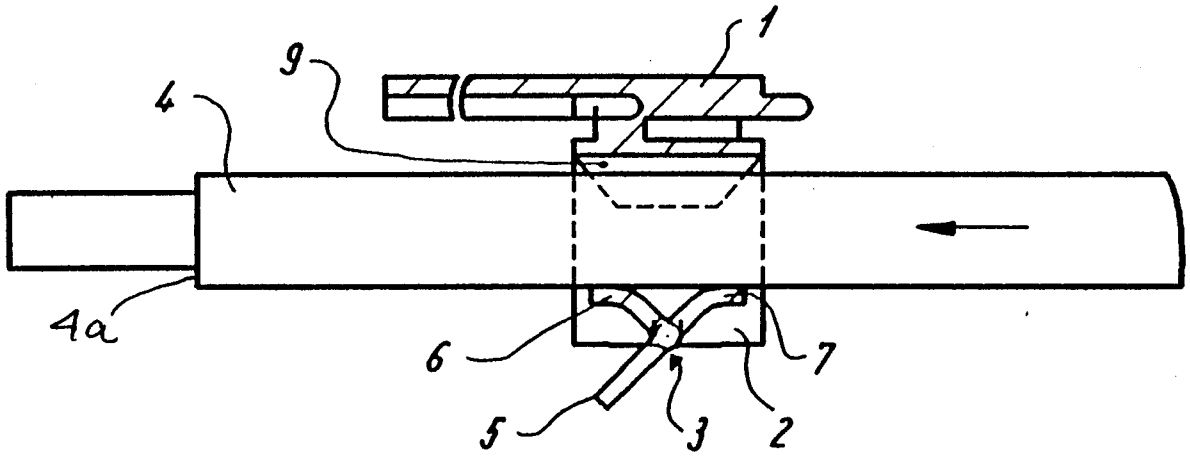
FIG. 4 and 5 are longitudinal sectional views illustrating the conductor inserted from the right-hand and left-hand ends of the attachment housing respectively.
Figure 5:
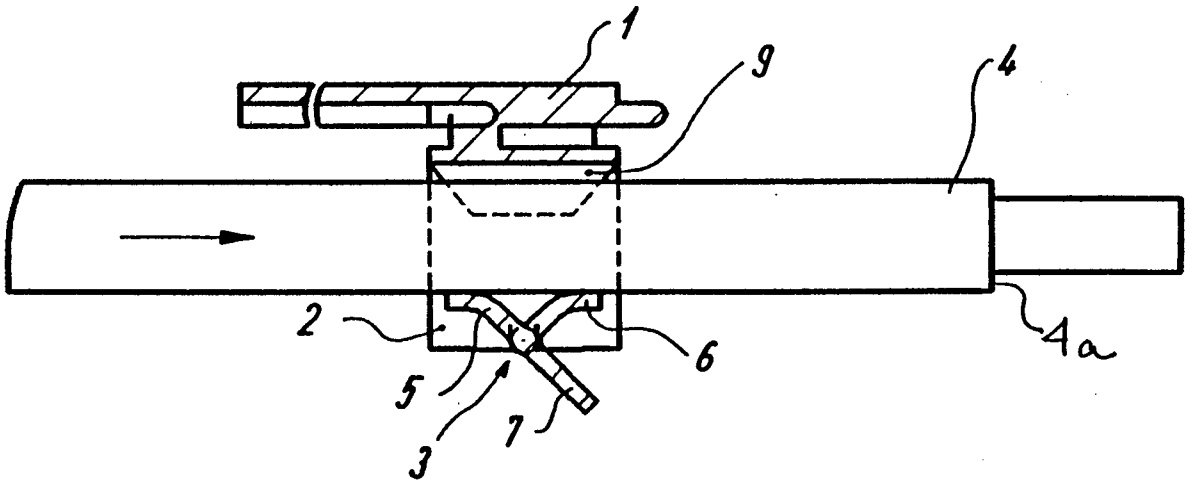

The arms 5, 6 and 7 of the clamp member 3 are resilient, as well as the clip fingers or legs 9. Referring to FIGS. 4 and 5, the conductor 4 may be longitudinally inserted within either end of the attachment housing, depending on the direction of reading of the indicia on the horizontal top wall 1. Thus, in FIG. 4, as the conductor 4 is introduced from the right-hand end from the housing, the extremity of the conductor will engage the vertical upwardly extending arm 5 of the clamp member 3, thereby to initiate pivotal movement of the clamp member 3 in the counter-clockwise direction relative to pivot axis 8. Upon further introduction of the conductor into the housing, the horizontal arm numeral 7 of the clamp member 3 pivots upwardly toward engagement with the lower surface of the conductor 4, thereby biasing the conductor 4 upwardly into engagement with the downwardly depending legs 9 on the top wall of the housing. Thus, depending upon the diameter of the conductor, the vertical arm 6 and horizontal arm 7 are deformed somewhat, as well as the legs 9 depending from the top wall of the housing. Similarly, if the conductor were to be inserted into the housing from the left-hand end thereof as shown in FIG. 5, the extremity of the conductor 4 initially engages the vertical arm 6 to pivot clamp member 3 in the clockwise direction, whereupon the horizontal arm 5 is pivoted upwardly into engagement with the lower surface of the conductor 4. Again, the conductor 4 is biased upwardly toward the clamping legs 9, which legs are resiliently deformed, as well as the arms 5 and 6, as shown. Thus, the conductor 4 is supported on its lower surface by a pair of longitudinally-spaced areas, and on its upper surface by a pair of laterally-spaced surfaces.

During insertion of the electrical conductor, the two upper resilient legs 9 serve as guide members for guiding the conductor into the housing chamber. Because the entry area of the housing chamber is generally open, the introduction of the conductor into either end of the housing presents no problem. The conductor can initially enter freely, and is then directly pressed toward the clamping rocker 3 by the widening of the clamping legs 9. The clamp member 3 is pivoted by the conductor 4 automatically upon further introduction of the conductor, and the deformation of the free ends of the clamping arms progresses automatically so as to achieve a stable support which will prevent tilting of the attachment relative to the conductor.

While clamping effect normally is produced by the cooperation of two clamping tongues or arms with the lower surface of the conductor, the clamping effect may also be produced by resiliency of the pivot rod 8, if desired.

The above described design therefore makes it possible to introduce—into one and the same information display device—electrical conductors with considerably differing diameters, and to securely clamp information display devices upon such conductors.

While in accordance with the provisions of the Patent Statutes the preferred form and embodiment of the invention has been illustrated and described, and it will apparent that various changes may be made without deviating from the concepts set forth above.

What is claimed is:

1. An indicia-bearing attachment adapted for mounting upon one end of an electrical conductor, comprising:

(a) a hollow generally U-shaped housing including a horizontal top wall (1), and a pair of spaced downwardly-extending side walls (2) cooperating with said top wall to define an open-ended chamber extending longitudinally through said housing, said top wall being adapted to bear indicia; and (b) first clamping means for connecting said attachment with the conductor with the indicia having a desired viewing orientation, said clamping means including:

(1) a generally T-shaped clamping member including a pair of horizontal arm portions (5,7), and a vertical stem portion (6) connected with said arm portions to define a juncture;

(2) said clamping member being arranged in inverted relation in said chamber with said arm portions extending generally longitudinally of the chamber and with said stem portion extending from said arm portions generally upwardly between said side walls toward said top wall; and (3) means pivotally connecting said clamping member between said side walls for pivotal movement about a pivot axis (8) that extends both transversely between said side walls and through said juncture, said pivot axis being spaced from said top wall by a distance greater than the length of said vertical stem portion, whereby upon longitudinal insertion of the conductor into said housing chamber from either end thereof between said clamping member and said housing top wall, the end extremity of the conductor engages said vertical stem portion to pivot said clamping member in a direction causing clamping of the conductor between one of said arm portions and said housing top wall.

2. An attachment as defined in claim 1, wherein said arm and stem portions are resilient and of such length that upon further insertion of the conductor end in said housing, said vertical stem portion and said one horizontal arm portion are resiliently bent by said conductor, thereby to resiliently bias the conductor upwardly in said housing chamber.

3. An attachment as defined in claim 2, wherein said housing side walls have horizontal lower edge portions, and further wherein said means pivotally connecting said clamp member with said housing comprises a pivot shaft (8) connected between said side wall lower edge portions, said clamping member being pivotally mounted on said pivot shaft.

4. An attachment as defined in claim 2, and further including second clamping means (9) connected with said top wall and extending downwardly in said chamber, the conductor being biased upwardly by said first clamping means into lateral engagement with said second clamping means.

5. An attachment as defined in claim 4, wherein said second clamping means comprises a clip member having a pair of downwardly directed resilient legs (9) spaced transversely of said chamber for engagement with circumferentially spaced portions of the conductor.

6. An attachment as defined in claim 5, wherein said clip member legs have such a length that said legs are biased apart by the conductor when the conductor is laterally biased upwardly by said first clamping means.

* * * * *